United States Patent [19]

Hattori et al.

[11] Patent Number: 4,798,487

[45] Date of Patent: Jan. 17, 1989

[54] THERMAL PRINTER HAVING RIBBON TAKE-UP MECHANISM UTILIZING CARRIAGE MOVEMENT

[75] Inventors: Shigenori Hattori, Aichi; Koshiro Yamaguchi, Nagoya, both of Japan

[73] Assignee: Brother Kogyo Kabushiki Kaisha, Japan

[21] Appl. No.: 45,413

[22] Filed: May 4, 1987

[30] Foreign Application Priority Data

May 10, 1986 [JP] Japan ..... 61-70382[U]
May 13, 1986 [JP] Japan ..... 61-71496[U]

[51] Int. Cl.[4] ..... B41J 33/22

[52] U.S. Cl. ..... 400/223; 400/236.2; 400/120

[58] Field of Search ..... 400/229, 120, 233, 236.2, 400/223

[56] References Cited

U.S. PATENT DOCUMENTS 4,563,692 1/1986 Negita et al. ..... 400/120
4,596,480 6/1986 Takada ..... 400/236.2
4,609,299 9/1986 Hattori et al. ..... 400/236.2

FOREIGN PATENT DOCUMENTS 0158988 12/1980 Japan ..... 400/120
0087057 5/1983 Japan ..... 400/145.2
0029166 2/1984 Japan ..... 400/146
0011385 1/1985 Japan ..... 400/229
0120085 6/1985 Japan ..... 400/233

*Primary Examiner*—E. S. Burr
*Assistant Examiner*—James Lisehora
*Attorney, Agent, or Firm*—Parkhurst, Oliff & Berridge

[57] ABSTRACT

A thermal printer having a take-up spool for taking up a print ribbon, an elongate normally stationary member disposed parallel to a direction of movement of a carriage along a platen, and a power transmitting mechanism supported on the carriage, for engagement with the normally stationary member, to rotate the take-up spool when the carriage is moved relative to the normally stationary member. The normally stationary member is held stationary by a frictional resistance applied thereto, but is movable in its longitudinal direction when a load applied to the take-up spool exceeds a predetermined limit. The normally stationary member and the power transmitting mechanism may be replaced by an immovably disposed stationary member, and a rotatable member rotatably supported on the carriage for engagement with the take-up spool for rotation of the spool. In this case, the rotatable member is rotated due to frictional engagement with the stationary member when the carriage is moved relative to the stationary member. The rotatable member may slip on the stationary member when the load applied to the take-up spool exceeds the limit.

11 Claims, 6 Drawing Sheets

THERMAL PRINTER HAVING RIBBON TAKE-UP MECHANISM UTILIZING CARRIAGE MOVEMENT

BACKGROUND OF THE INVENTION

1. Field of the Invention

The present invention relates to a thermal printer wherein a thermal print head mounted on a carriage is moved along a printing line on a recording medium, for thermal printing on the medium with a print ribbon having a thermally fusible ink layer.

2. Discussion of the Prior Art

In a known thermal printer, a drive for reciprocating the carriage is utilized to feed a print ribbon from a supply spool to a take-up spool. The carriage incorporates a mechanism for converting a linear movement of the carriage into a rotary movement of the take-up spool. For example, the carriage rotatably supports a take-up spool shaft engageable with the take-up spool, and a suitable rotating member such as a pinion. The pinion is adapted to engage an elongate stationary toothed belt or rack which extends in the direction of movement of the carriage, so that the pinion is rotated as the carriage is moved for printing. The carriage further has a power transmitting system for transmitting a rotary motion of the pinion to the take-up spool shaft and to the take-up spool for winding the used length of the print ribbon which has passed the print head. The power transmitting mechanism incorporates a frictional coupling device which has a first friction member rotatable with the take-up spool shaft, and a second friction member rotatable with the pinion, so that the rotation of the pinion is imparted to the take-up spool shaft by means of frictional engagement of the first and second friction members of the coupling device. The frictional coupling device permits a slip between the first and second friction members, so as to prevent the take-up spool from rotating when a rotational resistance applied to the take-up spool exceeds a given upper limit (a friction force between the friction members).

The frictional coupling device is provided in order to adjust the rotating speed of the take-up spool, as a function of the length of the print ribbon that has been wound on the take-up spool. More specifically, the effective diameter of the take-up spool, that is, the outside diameter of the ribbon wound on the take-up spool increases as the ribbon is fed from the supply spool to the take-up spool. Accordingly, the rate at which the print ribbon is wound on the take-up spool is gradually increased. Since the ribbon winding or take-up speed must be substantially equal to the speed of the carriage movement, the rotating speed of the take-up spool must be reduced as the diameter of the print ribbon wound on the take-up spool is increased.

With the frictional coupling device incorporated in the power transmitting mechanism between the pinion and the take-up spool shaft, there arises a slip between the first and second friction members while a frictional resistance applied to the take-up spool exceeds the friction force between the two friction members. The rotational resistance may exceed the friction force due to the higher winding speed of the take-up spool than the carriage moving speed. Thus, the amount of slip between the first and second friction members of the coupling device increases with an increasing diameter of the ribbon wound on the take-up spool increases.

However, the use of such a frictional coupling device complicates the power transmitting mechanism incorporated in the carriage, and results in increasing the size and weight of the carriage assembly as a whole. This necessitates a carriage drive that has a comparatively large capacity, and consequently leads to increased energy consumption of the printer.

The above tendency toward increased size and weight of the carriage due to the use of a frictional coupling device is created, since the carriage incorporates a rotating member such as a pinion which is kept in motion while engaging a longitudinal fixed member such as a rack, and further incorporates a frictional coupling device for connection of the rotating member to the take-up spool shaft in such a manner as to prevent the take-up spool from rotating with the rotating member. The tendency is remarkable particularly where the friction members of the coupling device have a relatively large surface of frictional contact with each other, for providing a consistent friction force therebetween, and thereby assuring a consistent drive force to rotate the take-up spool with sufficient operating stability. The increase in the size and weight of the carriage, and the need of a larger capacity of the carriage drive means, are contrary to the recent requirement for reduced size and energy consumption of the thermal printer, for lowering the manufacturing and operating costs of the printer.

SUMMARY OF THE INVENTION

It is accordingly an object of the present invention to provide a simple, less costly thermal printer which has a relatively small-sized, lightweight carriage and a relatively small-capacity carriage drive, and which utilizes a movement of the carriage to feed the print ribbon.

It is another object of the invention to provide such a thermal printer having an elongate member such as a toothed belt engaging a rotating member for rotating the ribbon take-up spool, wherein the elongate member can slip when an excessive load is applied to the take-up spool.

It is a further object of the invention to provide such a thermal printer wherein the rotating member itself can slip on an elongate stationary member upon application of an excessive load to the take-up spool.

According to the invention, there is provided a thermal printer for thermal printing on a recording medium via a print ribbon, comprising: (a) a generally elongate platen for supporting the recording medium; (b) a carriage reciprocatingly movable in a longitudinal direction of the platen; (c) carriage drive means for moving the carriage; (d) a thermal print head mounted on the carriage, and operable in pressed contact with the recording medium through the print ribbon, for effecting a printing operation on the recording medium; (e) a take-up spool rotatably supported on the carriage, for winding thereon the print ribbon after the ribbon has passed between the print head and the recording medium; (f) a generally elongate, longitudinally movable member disposed parallel to the longitudinal direction of the platen; (g) means for applying a frictional resistance to the movable member; and (h) a power transmitting mechanism supported on the carriage, and engageable with the movable member. The mechanism is activated due to a relative movement between the carriage and the movable member, for rotating the take-up spool.

In the thermal printer of the present invention constructed as described above, the longitudinally movable member is not moved while a rotational resistance applied to the take-up spool is smaller than the frictional resistance applied to the movable member. In this condition, a movement of the carriage relative to the stationary movable member will cause the power transmitting mechanism to be activated to rotate the take-up spool. However, when the rotational resistance of the take-up spool exceeds the frictional resistance applied to the longitudinally movable member, the movable member is moved due to slippage, at a speed lower than the moving speed of the carriage. In this condition, the power transmitting mechanism is operated at a reduced speed, so that the print ribbon is wound on the take-up spool at a rate equal to the rate of movement of the carriage. Namely, the ribbon take-up speed is reduced to an extent corresponding to an amount of slip of the movable member.

Further, the present thermal printer does not use a frictional coupling device disposed between the take-up spool shaft and a rotatable or rotating member of the power transmitting mechanism. According to the present invention as described above, the rotating member itself may be prevented from rotating when an excessive force is applied to the take-up spool. Therefore, the size and weight of the carriage as a whole can be accordingly reduced, whereby the carriage may be operated with a drive source having a reduced capacity, as compared with a drive used in the conventional thermal printer. Accordingly, the printer may be made compact, and the manufacturing and operating costs can be lowered.

According to one feature of the invention, the thermal printer further comprises a plurality of toothed pulleys, and tbe movable member comprises a toothed endless belt connecting the toothed pulleys. The means for applying a frictional resistance comprises at least one of the plurality of toothed pulleys, a stationary member, and at least one friction member each of which is interposed between respective one of the at least one of the toothed pulleys and the stationary member. In this case, the toothed pulley or pulleys will slip on the stationary member via the respective friction member or members, permitting the toothed endless belt to be moved with the carriage, when an excessive load is applied to the take-up spool.

In one form of the above feature of the invention, the at least one friction member comprises at least one felt sheet each of which is interposed between the stationary member, and a face of the respective toothed pulley opposite to the stationary member. In this case, the printer may be adapted such that each toothed pulley is axially movable, and the means for applying a frictional resistance further comprises an elastic member for forcing the face of the respective toothed pulley against the stationary member via the felt sheet.

In another form of the same feature of the invention, the power transmitting mechanism comprises a take-up spool shaft engaging the take-up spool for rotation of the take-up spool, a first gear fixed on the take-up spool shaft, a second gear engaging the first gear and the toothed endless belt, and a pivotable lever rotatably supporting the second gear at a free end thereof. The pivotable lever is supported pivotally about the take-up spool shaft for moving the second gear between an operative position thereof in which the second gear engages the toothed endless belt, and a retracted position thereof in which the second gear does not engage the endless belt.

According to one arrangement of the above form of the invention, the second gear consists of a large-diameter gear engaging the first gear, and a small-diameter gear which is formed integrally with the large-diameter gear and which engages the toothed endless belt.

According to another arrangement of the same form of the invention, the printer further comprises a support arm pivotally supported on the carriage and having the thermal print head fixed at a free end thereof, and a driving mechanism for operating the support arm, so as to move the print head between a printing position thereof in which the print head is held in pressed contact with the recording medium through the print ribbon, and a non-printing position thereof in which the print head is spaced away from the recording medium. In this case, the thermal printer may further comprises a linkage disposed between the support arm and the pivotable lever, for pivoting the pivotable lever so as to move the second gear to the retracted position, when the thermal print head is moved to the non-printing position.

According to another aspect of the present invention, there is provided a thermal printer for thermal printing on a recording medium via a print ribbon, comprising: (a) a generally elongate platen for supporting the recording medium; (b) a carriage reciprocatingly movable in a longitudinal direction of the platen; (c) carriage drive means for moving the carriage; (d) a thermal print head mounted on the carriage, and operable in pressed contact with the recording medium through the print ribbon, for effecting a printing operation on the recording medium; (e) a take-up spool rotatably supported on the carriage, for winding thereon the print ribbon after the ribbon has passed between the print head and the recording medium; (f) an elongate stationary member disposed parallel to the longitudinal direction of the platen, and immovable in the longitudinal direction, the stationary member having a friction surface extending in a longitudinal direction thereof; and (g) a rotatable member rotatably supported on the carriage and engaging the take-up spool for rotation of the take-up spool. The rotatable member is frictionally engageable with the friction surface of the stationary member, for rotation of the rotatable member due to a relative movement between the rotatable member and the stationary member in the longitudinal direction of the friction surface. A friction force between the rotatable member and the friction surface of the stationary member is determined so as to permit the rotatable member to be rotated to rotate the take-up spool when a rotational load applied to the take-up spool is smaller than a predetermined amount, but to cause a slip between the rotatable member and the stationary member in the longitudinal direction of the stationary member, when the rotational load exceeds the predetermined amount.

In the thermal printer according to the present aspect of the invention, the rotatable member is rotated due to frictional engagement thereof with the elongate stationary member, when the carriage is moved relative to the stationary member. However, the rotatable member will slip on the stationary member in the longitudinal direction of the latter, when the rotational resistance applied to the take-up spool exceeds a predetermined upper limit. The slip of the rotatable member relative to the stationary member will reduce the rotating speed of the rotatable member, to an extent corresponding to an amount of the slip therebetween. Thus, no frictional coupling device is disposed between the take-up spool and the rotatable member rotatably supported on the carriage. Therefore, the carriage of the instant printer may be made comparatively compact, and lightweight, permitting reduction in the require capacity of the carriage drive means. Further, the instant arrangement allows the rotatable member to frictionally engage the stationary member, at any position on the friction surface of the stationary member, unlike a rack-and-pinion arrangement wherein a pinion or gear can engage a toothed belt or rack only when the teeth of the pinion or gear are aligned with those of the belt or rack.

According to one feature of the above aspect of the invention, the thermal printer further comprises a take-up spool shaft engaging the take-up spool for rotation of the take-up spool. In this case, the stationary member has the friction surface on each of opposite surfaces thereof, and the rotatable member comprises a pair of friction disks which engage the take-up spool shaft such that the friction disks are rotatable with the take-up spool shaft and are movable toward and away from each other in an axial direction of the take-up spool shaft. Biasing means is provided for biasing the pair of friction disks toward each other, so as to hold the friction disks in frictional engagement with the respective opposite friction surfaces of the stationary member.

In one form of the above feature of the invention, the pair of friction disks have a pair of felt sheets secured to mutually facing surfaces thereof. The felt sheets are engageable with the respective opposite friction surfaces of the stationary member. In this instance, the printer may further comprise an actuator supported on the carriage, movably between an operative position thereof in which the actuator is inserted between the pair of friction disks and moves the disks away from each other to thereby disengage the disks from the stationary member, and an inoperative position thereof in which the actuator is located away from the pair of friction disks. In this case, the printer may further comprise a support arm pivotally supported on the carriage and having the thermal print head fixed at a free end thereof, and a driving mechanism for operating the support arm, so as to move the print head between a printing position thereof in which the print head is held in pressed contact with the recording medium through the print ribbon, and a non-printing position thereof in which the print head is spaced away from the recording medium. The actuator is attached to the support arm so that the actuator is moved to the operative position when the thermal print head is moved to the non-printing position.

BRIEF DESCRIPTION OF THE DRAWINGS

The above and other objects, features and advantages of the present invention will be better understood by reading the following detailed description of preferred embodiments of the invention, when considered in connection with the accompanying drawings, in which.

DETAILED DESCRIPTION OF THE PREFERRED EMBODIMENTS

Figure 1:
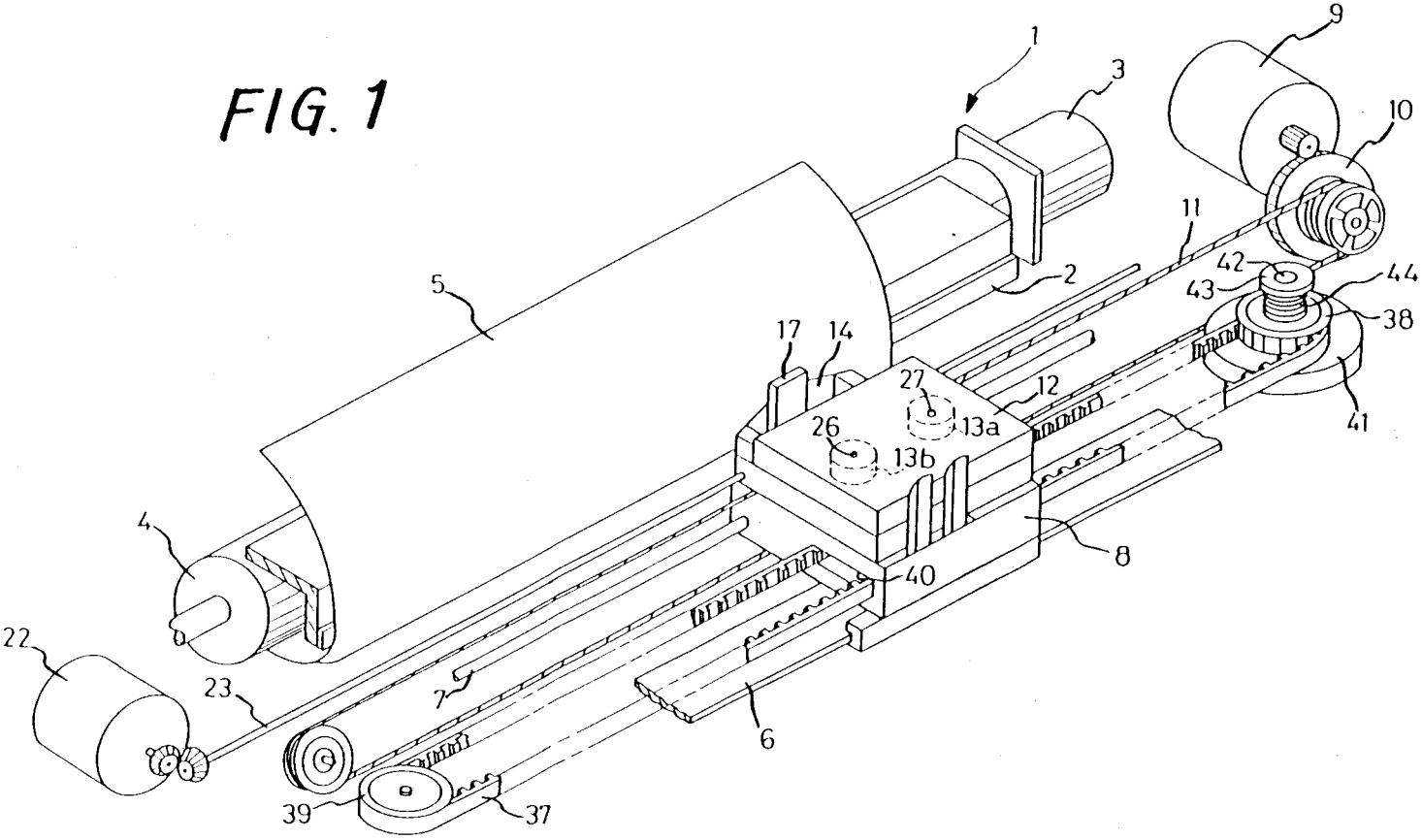
FIG. 1 is a fragmentary perspective view of one embodiment of a thermal printer of the present invention.

Referring first to FIG. 1, there is illustrated a thermal printer constructed according to the invention, generally indicated at 1 in FIG. 1. In the printer 1, a generally elongate platen 2 is fixedly disposed so as to extend between a pair of side frames (not shown) of the printer. The platen 2 has a planar surface for supporting a recording medium in the form of a cut sheet 5, which is advanced or fed by the rotation of a feed roll 4 disposed parallel to the elongate platen 2. The feed roll 4 is rotated by a paper feed motor 3, to feed the cut sheet 5 in a direction perpendicular to the axis of rotation of the feed roll. To the side frames of the printer, there are also fixed a carriage guide 6 and a guide rod 7 which extend parallel to the platen 2, so that a carriage 8 is slidably movable on the guide 6 and the guide rod 7, in a reciprocating fashion, in the longitudinal direction of the elongate platen 2. More specifically, a carriage dirve motor 9 is operatively connected to the carriage 8, through a drive pulley 10 coupled to the motor 9, and a drive wire 11 which is wound on the pulley 10 and connected to the carriage 8. In this arrangement, the carriage 8 is reciprocated as the drive motor 9 is operated in the opposite directions. The carriage 8 is equipped with a removable ribbon cassette 12. The cassette 12 has a supply spool 13*a* and a take-up spool 13*b* rotatably accommodated therein, so that a print ribbon 14 having a thermally fusible ink layer is supplied from the supply spool 13*a*, and the used portion of the ribbon 14 is wound on the take-up spool 13*b*, due to the rotation of the take-up spool 13*b*.

Figure 2:
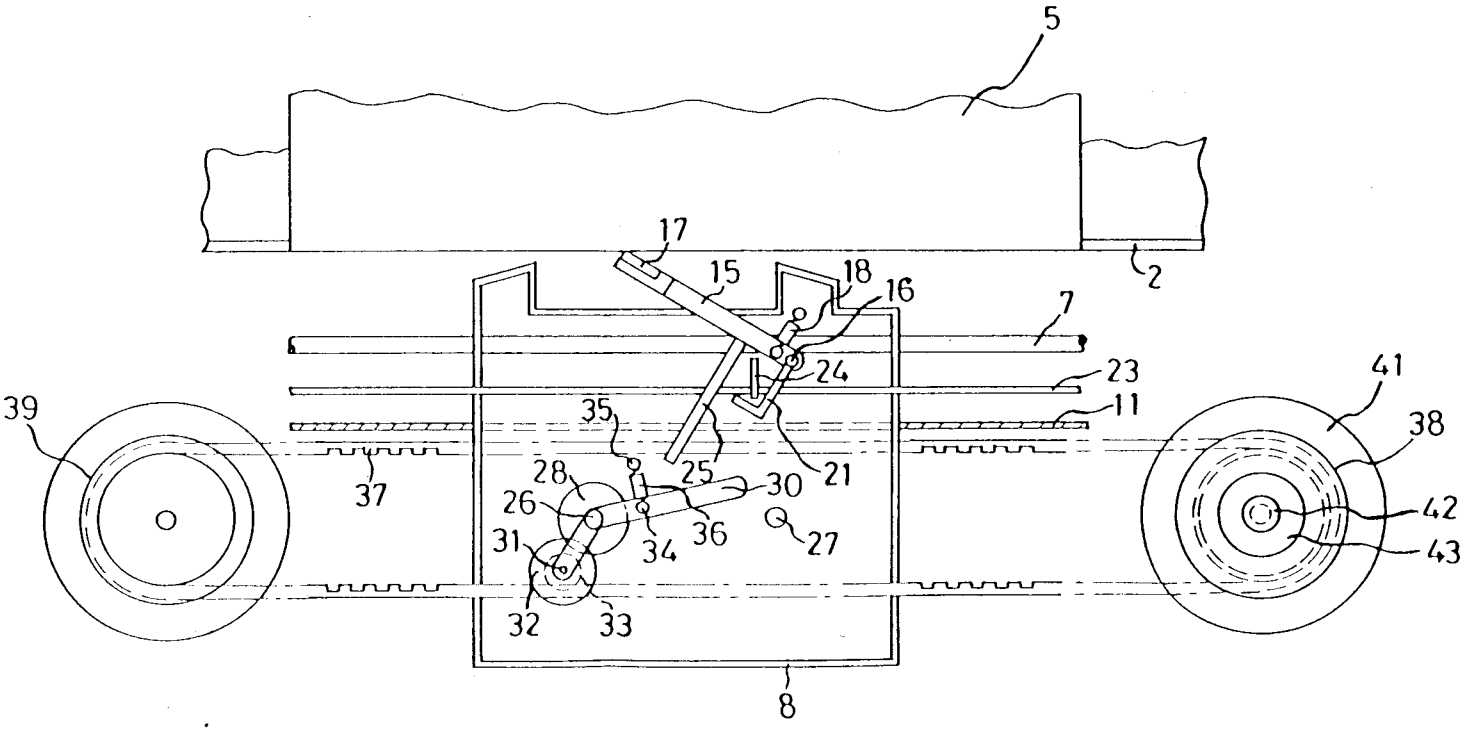
FIG. 2 is a fragmentary plan view of the printer of FIG. 1, illustrating the internal mechanism of the carriage when placed in the printing position.
Figure 3:
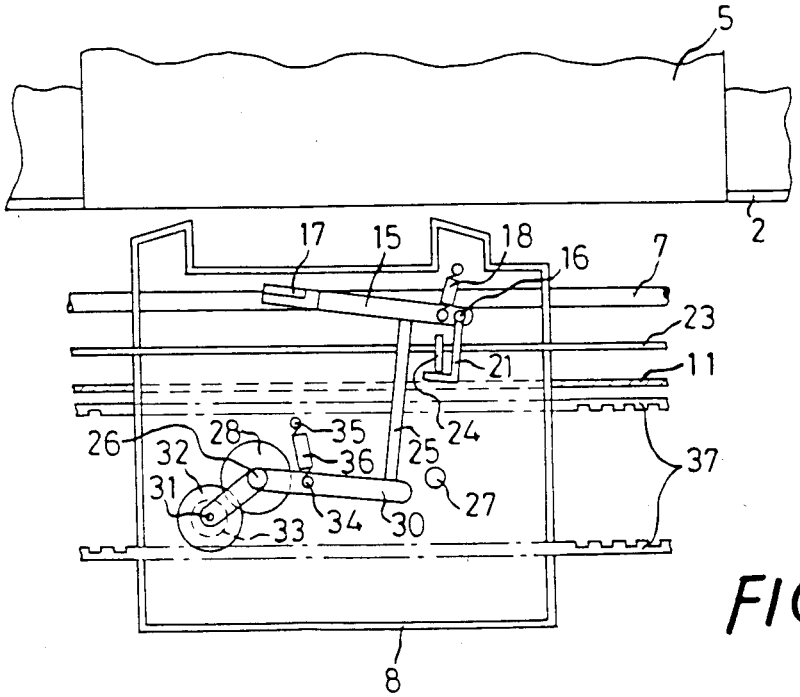
FIG. 3 is a view corresponding to FIG. 2, illustrating the internal mechanism of the carriage when placed in the non-printing position.
Figure 4:
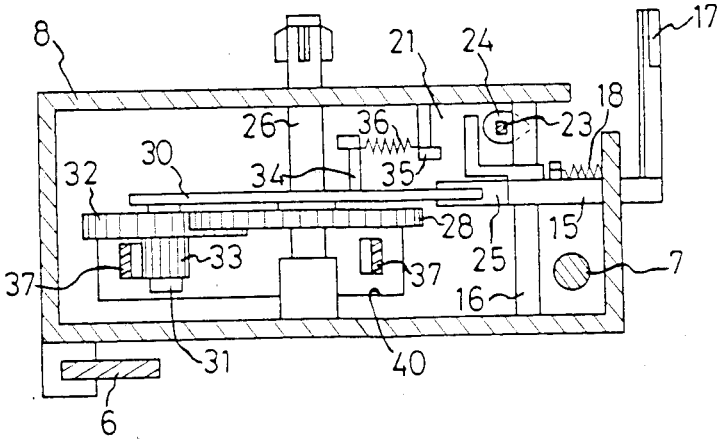
FIG. 4 is a side elevational view in cross section of the carriage.

Referring next to FIGS. 2, 3 and 4, the internal structure of the carriage 8 of the thermal printer 1 will be described in detail.

At a portion of the carriage 8 near the platen 2, there is supported a support arm 15 such that the arm 15 is pivotable at its one end about a support shaft 16 fixed to the carriage 8. This support arm 15 has a thermal print head 17 fixed thereto at its other or free end. The print head 17 has a multiplicity of heat generating elements arranged substantially in the direction of which the cut sheet 5 is fed. These heat generating elements are selectively energized according to printing data, fusing the corresponding portions of the print ribbon 14 and transferring the fused ink material to the sheet 5, thereby permitting dot-matrix printing of characters or any other images on the sheet 5. The support arm 15 supporting the print head 17 is biased in a clockwise direction (in FIG. 2) about the support shaft 7 by a coil spring 18, which is connected to the arm 15 and the carriage 8. Thus, the print head 17 is normally placed in its printing position of FIG. 2 in which the print head 17 is held in pressed contact with the surface of the platen 2 (cut sheet 5 on the platen), by a suitable pressure.

The support arm 15 has an L-shaped cam follower 21 secured to the fixed end, at which the arm 15 is pivotally supported by the shaft 16. The cam follower 21 extends in a direction away from the platen 2, so that the cam follower 21 is engageable with an elliptical peripheral cam 24 slidably supported on a cam shaft 23. As shown in FIG. 1, the cam shaft 23 is coupled to a drive motor 22, whereby the cam 24 is rotated by the motor 22 via the cam shaft 23. The cam 24 is sandwiched by a fork consisting of a pair of tabs (not shown) formed on the carriage 8, so that the cam 24 is slidably moved on the cam shaft 23 when the carriage 8 is moved along the platen 2. With the rotation of the peripheral cam 24 which is engageable with the cam follower 21, the support arm 15 is pivoted between its operative or printing position of FIG. 2 in which the print head 17 is in pressed contact with the platen 2 under the biasing action of the coil spring 18, and its retracted or non-printing position of FIG. 3 in which the print head 17 is located away from the platen 2 against the biasing force of the coil spring 18. As described later, the elements 18, 21, 22, 23 and 24 constitute a mechanism for operating the support arm 15 between its printing and non-printing positions.

The support arm 15 further has an actuator bar 25 fixed thereto at a point between the L-shaped cam follower 21 and the print head 17, such that the actuator bar 25 may function as a linkage for imparting a pivotal motion of the support arm 15 to a pivotable lever 30 (which will be described), when the support arm 15 is moved to its non-printing position of FIG. 3.

The carriage 8 incorporates a power transmitting mechanism which includes a take-up spool shaft 26 for rotating the take-up spool **13*b*. The take-up spool shaft 26 is rotatably supported on the carriage 8, and extends upright for engagement with the take-up spool 13*b* at its upper end, as most clearly shown in FIG. 4. Similarly, a supply spool shaft 27 is rotatably supported to the right of the take-up spool shaft 26 (in FIG. 2), for rotatably supporting the supply spool 13*a*. The power transmitting system further includes a drive gear (first gear) 28 fixed to an intermediate portion of the take-up spool shaft 26, and the above-indicated pivotable lever 30 which is supported pivotally by the take-up spool shaft 26. The pivotable lever 30 is bent a suitable angle at its axis of pivot (axis of the take-up spool shaft 26). Namely, the pivotable lever 30 consists of a first long arm and a second short arm which extend from the take-up spool shaft 26, so as to form a given angle. The second arm of the pivotable lever 30 has a shaft 31 fixed thereto at its end, such that the shaft 31 extends downwardly from the lower surface of the second arm. This shaft 31 rotatably supports a second gear which consists of a large-diameter intermediate gear 32 engaging the first or drive gear 28, and a small-diameter gear in the form of a pinion 33 formed integrally with the large-diameter intermediate gear 32. The pivotable lever 30 has a pin 34 fixed thereto, while the carriage 8 has another pin 35 fixed thereto. A coil spring 36 is connected to these pins 34, 35, so that the pivotable lever 30 is biased by the coil spring 36 in the counterclockwise direction (in FIG. 2) about the take-up spool shaft 26. Thus, the pivotable lever 30 is normally placed in its operative position of FIG. 2 in which the pinion 33 engages an elongate longitudinally movable member in the form of a toothed endless belt 37 which is normally stationary, but is movable in the longitudinal direction of the platen 2**.

Figure 5:
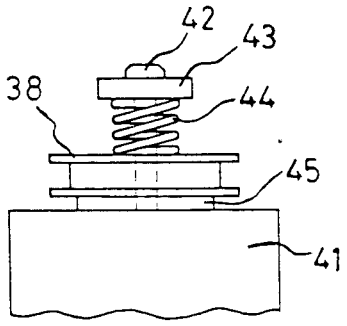
FIG. 5 is an elevational view showing a toothed pulley in pressed contact with a stationary member.

The toothed endless belt 37 takes the form of a loop extending between two toothed pulleys 38, 39, such that the opposite parallel straight portions of the loop pass through an opening 40 formed in the carriage 8, as shown in FIGS. 1 and 2. These pulleys 38, 39 are rotatably disposed on the frame of the printer 1. While the pulley 39 is freely rotatable if the endless belt 27 is rotated, the pulley 38 is normally immovable with a frictional resistance applied thereto. Stated in more detail referring to FIG. 5, the pulley 38 is fitted on a support shaft 42 secured to a frame 41, such that the pulley 38 is movable on the shaft 42 in the axial direction of the shaft 42. The support shaft 42 has a disk 43 fixed at its upper end. A compression coil spring 44 is disposed between the disk 43 and the toothed pulley 38, for forcing the toothed pulley 38 toward the frame 41. The pulley 38 has a sheet 45 made of a felt, secured to the lower surface, so that the pulley 38 is forced against the frame 41 via the felt sheet 45, due to a biasing force of the compression coil spring 44. Thus, a predetermined amount of frictional resistance is applied to the toothed pulley 38, whereby the toothed endless belt 37 as the elongate movable member is normally stationary. However, when a force greater than the above frictional resistance is applied from the pinion 33 to the toothed pulley 38 via the toothed endless belt 37, the pulley 38 will slip on the frame 41, permitting the belt 37 to rotate as the pinion 33 is moved together with the carriage 8. The elements 38, 41, 44 and 45 consitute means for applying a frictional resistance to the toothed endless belt 37 as the elongate longitudinally movable member 37.

There will be described an operation of the thermal printer 1 described above.

Prior to starting a printing movement of the carriage 8 along the platen 2, the drive motor 22 is operated to rotate the cam shaft 23 by a suitable angle necessary to disengage the elliptical peripheral cam 24 from the cam follower 21 of the support arm 15. As a result, the support arm 15 is pivoted clockwise (in FIG. 2) from its non-printing or retracted position to the printing position of FIG. 2, under the biasing action of the coil spring 18. Thus, the thermal print head 17 is brought into pressed contact with the surface of the cut sheet 5 on the planar platen 2. Then, the carriage 8 is moved in the printing direction (in the right direction as viewed in FIG. 2), by the carriage drive motor 9. As the carriage 8 is moved, the heat generating elements of the print head 17 are selectively energized according to the printing data, whereby a desired printing is effected in a dot-matrix fashion. As the thermal print head 17 is moved along the platen 2, the print ribbon 14 is continuously fed from the supply spool 13a. In the meantime, the pinion 33 engaging the toothed endless belt 37 is rotated in the clockwise direction due to a longitudinal movement of the carriage 8 (pinion 33) relative to the endless belt 37. This rotating motion of the pinion 33 is imparted to the drive gear 28 via the intermediate gear 32, and to the take-up spool shaft 26. Consequently, the take-up spool **13*b* engaging the take-up spool shaft 26 is rotated in the counterclockwise direction, causing the used length of the print ribbon 14 to be wound on the take-up spool 13*b***.

The rate at which the ribbon 14 is taken up by the take-up spool **13*b* if it is assumed that the belt 37 will not slip, is determined by the gearing ratio of the pinion 33, intermediate gear 32 and drive gear 28, and by the current effective diameter of the take-up spool 13*b* (i.e., the current outside diameter of the ribbon 14 wound on the spool 13***b*). This rate is larger than the rate of movement of the carriage 8, and therefore the print ribbon 14 is held tight at its portion between the take-up spool 13*b*, and the print head 17 which forces the print ribbon 14 against the sheet 5. However, when the tension applied to that portion of the print ribbon 14, i.e., the load applied to the take-up spool 13*b* considerably exceeds the above-indicated frictional resistance applied to the toothed pulley 38, this toothed pulley 38 will slip on the frame 41, permitting the toothed endless blet 37 to rotate in the counterclockwise direction. As a result, the straight portion of the loop of the endless belt 37 engaging the pinion 33 is moved together with the carriage 8, without rotation of the pinion 33, whereby the portion of the print ribbon 14 which has passed the print head 17 is not wound on the take-up spool 13*b*.

While the slip of the endless belt 37 has been described to the effect that the slip results in the movement of the belt 37 without rotation of the pinion 33, for easy understanding and simplification, the slip of the belt 37 is accompanied by a rotating motion of the pinion 33 at a reduced speed so that the print ribbon 14 is wound on the take-up spool 13*b* at a rate equal to the rate of movement of the carriage 8.

At the end of a printing movement of the carriage 8 in the printing direction, the drive motor 22 is rotated by a suitable angle, for rotating the peripheral cam 23 into engagement with the cam follower 21, so as to pivot the support arm 15 in the counterclockwise direction against the biasing action of the spring 18, thereby move the print head 17 away from the platen 2. Simultaneously, the pivotal movement of the support arm 15 causes the actuator bar 25 to engage the first arm of the pivotable lever 30, pivoting the lever 30 in the clockwise direction so as to move the pinion 33 away from the toothed endless belt 37.

While the printer described above and illustrated in FIGS. 1–5 is adapted such that only the pulley 38 is provided with means for applying a frictional resistance thereto, as illustrated in FIG. 5, it is possible that both of the pulleys 38 and 39 are provided such means. In this case, the toothed pulleys 38, 39 may be made comparatively small in diameter. Further, it is possible to apply a frictional resistance directly to the toothed endless belt 37, rather than to the pulley or pulleys 38, 39.

Another embodiment of the thermal printer of the invention will be described, by reference to FIGS. 6–9. In the interest of brevity and simplification, the same reference numerals as used in FIGS. 1–5 will be used to identify the corresponding components, and redundant description of these components will not be provided.

Figure 8:
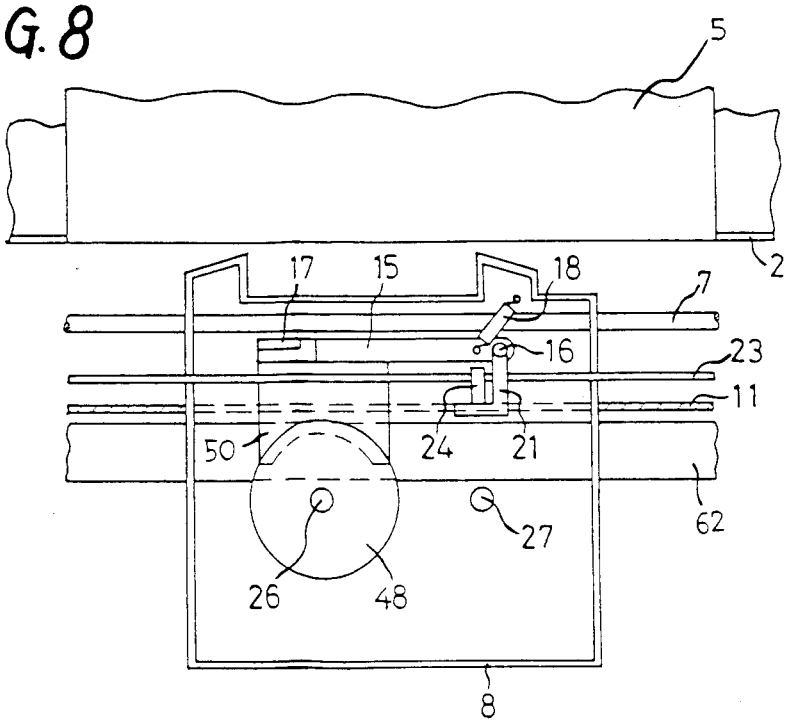
FIG. 8 is a plan view of the printer of FIG. 6, corresponding to that of FIG. 3.
Figure 9:
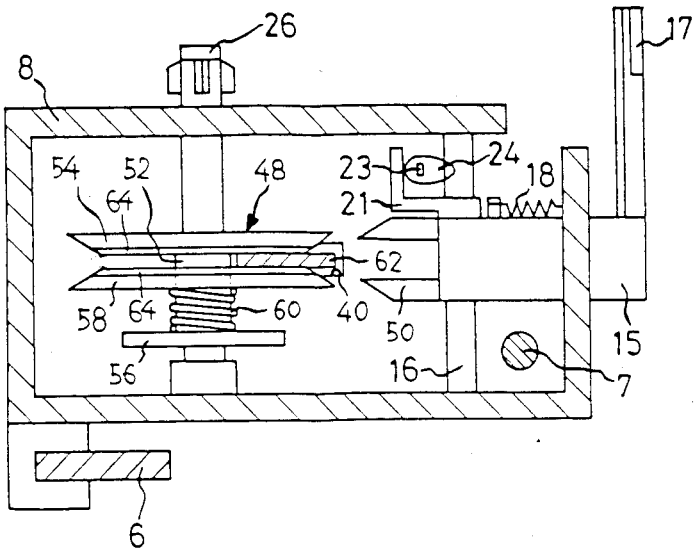
FIG. 9 is a side elevational view in cross section of the printer of FIG. 6.

In the present modified embodiment, the carriage 8 incorporates a power transmitting mechanism including a frictionally rotating device 48 as most clearly shown in FIG. 9. This rotating device 48 is fitted on the take-up spool shaft 26 such that the rotating device 48 is axially movable on the shaft 26 and rotatable with the shaft 26. Further, the support arm 15 has an actuator 50 in the form of two release members, in place of the actuator bar 25 used in the preceding embodiment of FIGS. 1–5. As illustrated in FIGS. 6–9, the actuator 50 extends from the support arm 15 in a direction away from the platen 2, for moving first and second friction disks 54, 58 of the rotating device 48 from each other, when the support arm 15 is pivoted to its non-printing or retracted position, as described later in detail. For this purpose, the two release members of the actuator 50 are chamfered at their actuating ends, as indicated in FIG. 9, and the chamfered ends have an arcuate shape following the periphery of the friction disks 54, 58, as seen in FIGS. 7, 8, so that the actuating ends of the release members of the actuator 50 may engage the peripheral parts of the friction disks 54, 58, for moving these disks away from each other upon insertion of the actuator 50 between the disks 54, 58.

The rotating device 48 consists of: the first and second friction disks 54, 58 indicated above; a cylindrical portion 52; and a lower disk 56 secured to the lower end of the cylindrical portion 52, as an integral part of the latter. The first friction disk 54 is secured to the upper end of the clindrical portion 52, also as an integral part of the latter. Namely, the cylindrical portion 52, the first friction disk 54 and the lower disk 56 constitute an integral one-piece member. The second friction disk 58 is axially slidably fitted on the cylindrical portion 52, so that the disk 58 is rotated with the cylindrical portion 52. The first and second friction disks 54, 58 are chamfered at their periphery, such that the chamfered surfaces face each other.

Between the lower disk 56 and the second friction disk 58, there is disposed a compression coil spring 60 which biases the lower disk 56 and the first disk 54 in the downward direction, and the second disk 58 in the upward direction. Namely, the spring 60 biases the first and second friction disks 54, 58 toward each other.

Figure 6:
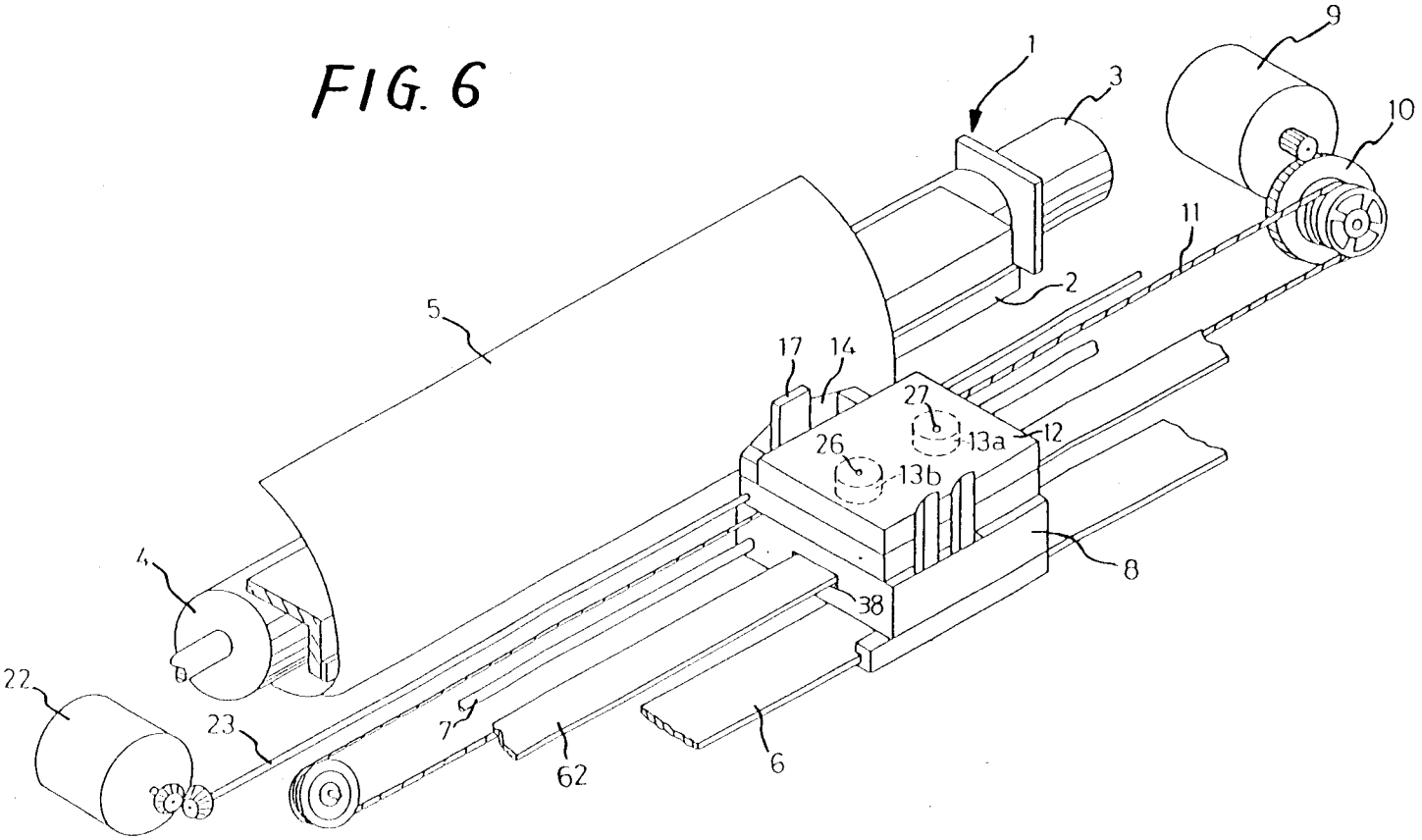
FIG. 6 is a fragmentary perspective view of another embodiment of the invention.
Figure 7:
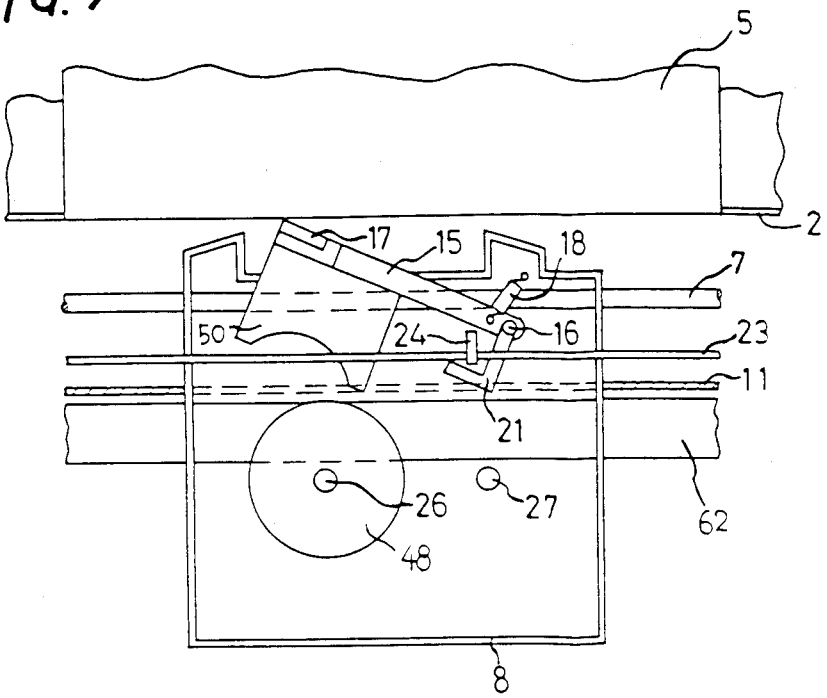
FIG. 7 is a plan view of the printer of FIG. 6, corresponding to that of FIG. 2.

An elongate stationary member in the form of an elongate strip 62 is disposed parallel to the platen 2, extending through the opening 40 formed through the carriage 8, as shown in FIGS. 6–8. The elongate strip 62 has a friction surface on each of the opposite major surfaces. The elongate strip 62 extends between the first and second friction disks 54, 58, so that the corresponding parts of felt sheets 64 secured to the inner surfaces of the disks 54, 58 are engageable with the respective friction surfaces of the elongate strip 62. While the support arm 15 is placed in its printing position of FIG. 7 wherein the actuator 50 is located away from the rotating device 48, the elongate strip 62 is held in frictional engagement with the felt sheets 64 on the first and second disks 54, 58, due to the biasing force of the compression coil spring 60, as indicated in FIG. 9.

There will be described an operation of the present modified thermal printer.

As in the preceding embodiment, the printing operation is effected with the support arm 15 held in its printing position of FIG. 7 under the biasing action of the coil spring 18. As the thermal print head 17 is moved with the carriage 8, the print ribbon 14 is continuously supplied from the supply spool 13*a*. In the meantime, a movement of the carriage 8 relative to the stationary elongate strip 62 caused a counterclockwise rotating motion (in FIG. 7) of the rotating device 48 engaging the elongate strip 62, thereby rotating the take-up spool 13*b* on the take-up spool shaft 26. Thus, the used length of the print ribbon 14 is wound on the take-up spool 13*b*.

The rate at which the ribbon 14 is taken up by the take-up spool 13*b*, is determined by the current effective diameter of the take-up spool 13*b*. In this embodiment, this rate is larger than the rate of movement of the carriage 8, and therefore the print ribbon 14 is held tight at its portion between the take-up spool 13*b*, and the print head 17 which forces the print ribbon 14 against the sheet 5. However, when the tension applied to that portion of the print ribbon 14, i.e., the load applied to the take-up spool 13*b* considerably exceeds the friction force between the rotating device 48 and the stationary elongate strip 62, there arises a slip between the rotating device 48 and the elongate strip 62, in the longitudinal direction of the strip. As a result, the rotating speed of the rotating device 48 is reduced, so that the print ribbon 14 is taken up at a speed equal to the speed of the carriage movement.

When the support arm 15 is pivoted to the non-printing or retracted position of FIG. 8, against the biasing force of the spring 18, by the peripheral cam 24 engaging the cam follower 21, the chamfered ends of the two release members of the actuator 50 are brought into sliding engagement with the chamfered peripheries of the first and second friction disks 54, 58 of the rotating device 48, thereby forcing the two disks 54, 58 to move away from each other. Thus, the friction disks 54, 58 are disengaged from the friction surfaces of the stationary elongate strip 62. In this position, the carriage 8 is freed from a load due to the frictional engagement with the elongate strip 62.

While the present invention has been described in its preferred embodiments, it is to be understood that the invention is not limited to the precise details of the illustrated embodiments, but may be embodied with various changes, modifications and improvements, which may occur to those skilled in the art, without departing from the scope and spirit of the invention defined in the following claims.

What is claimed is:

1. A thermal printer for thermal printing on a recording medium via a print ribbon, comprising:

a generally elongate platen for supporting said recording medium;

a carriage reciprocatingly movable in a longitudinal direction of said platen;

carriage drive means for moving said carriage;

a thermal print head mounted on said carriage, and operable in pressed contact with said recording medium through said print ribbon, for effecting a printing operation on said recording medium;

a take-up spool rotatably supported on said carriage, for winding thereon said print ribbon after the ribbon has passed between said print head and said recording medium;

a generally elongate, longitudinally movable member disposed parallel to said longitudinal direction of the platen;

means for applying a frictional resistance corresponding to the rotational load applied to said take-up spool when said print ribbon has a suitable tension to said a power transmitting mechanism supported on said carriage, and engageable with said movable member, said mechanism being activated due to a relative movement between said carriage and said movable member, for rotating said take-up spool, whereby said movable member is movable at a speed lower than a moving speed of said carriage, so as to maintain said suitable tension.

2. A thermal printer according to claim 1, further comprising a plurality of toothed pulleys, and wherein said movable member comprises a toothed endless belt engaging said toothed pulleys, said means for applying a frictional resistance comprising at least one of said plurality of toothed pulleys, a stationary member, and at least one friction member , said at least one friction member being interposed between one of said at least one of the toothed pulleys and said stationary member.

3. A thermal printer according to claim 2, wherein said at least one friction member comprises at least one felt sheet each of which is interposed between said stationary member and a face of said respective toothed pulley opposite to said stationary member.

4. A thermal printer according to claim 3, wherein said toothed pulley is axially movable, and said means for applying a frictional resistance further comprising an elastic member for forcing said face of said respective toothed pulley against said stationary member via said felt sheet.

5. A thermal printer according to claim 2, wherein said power transmitting mechanism comprises a take-up spool shaft engaging said take-up spool for rotation of the take-up spool, a first gear fixed on said take-up spool shaft, a second gear engaging said first gear and said toothed endless belt, and a pivotable lever rotatably supporting said second gear at a free end thereof, said pivotable lever being support pivotally about said take-up spool shaft for moving said second gear between an operative position thereof in which the second gear engages said tooothed endless belt, and a retracted position thereof in which the second gear does not engage said endless belt.

6. A thermal printer according to claim 5, wherein said second gear consists of a large-diameter gear engaging said first gear, and a small-diameter gear which is formed integrally with said large-diameter gear and which engages said toothed endless belt.

7. A thermal printer according to claim 5, further comprising a support arm pivotally supported on said carriage and having said thermal print head fixed at a free end thereof, and a driving mechanism for operating said support arm, so as to move said print head between a printing position thereof in which the print head is held in pressed contact with said recording medium through said print ribbon, and a non-printing position thereof in which the print head is spaced away from said recording medium, said thermal printer further comprising a linkage disposed between siad support arm and said pivotable lever, for pivoting said pivotable lever so as to move said second gear to said retracted position, when said thermal print head is moved to said non-printing position.

8. A thermal printer for thermal printing on a recording medium via a print ribbon, comprising:

a generally elongate platen for supporting said recording medium;

a carriage reciprocatingly movable in a longitudinal direction of said platen;

a carriage drive means for moving said carriage;

a thermal print head mounted on said carriage, and operable in pressed contact with said recording medium through said print ribbon, for effecting a printing operation on said recording medium;

a take-up spool rotatably supported on said carriage, for winding thereon said print ribbon after the ribbon has passed between said print head and said recording medium;

a take-up spool shaft engaging said take-up spool for rotation of the take-up spool;

an elongated stationary member disposed parallel to said longitudinal direction of the platen, and immovable in said longitudinal direction, said stationary member having opposite friction surfaces extending in a longitudinal direction thereof;

a pair of rotatable friction disks rotatably supported on said carriage and engaging said take-up spool shaft such that the frictions disk are rotatable with said take-up spool shaft and are movable toward and away from each other in an axial direction of said take-up spool shaft; and biasing means for biasing said pair of rotatable friction disks toward each other, so as to hold said friction disks in frictional engagement with said respective opposite friction surface of said stationary member, for rotation of said rotatable friction disks due to a relative movement between the rotatable friction disks and said stationary member in said longitudinal direction of said friction surfaces, a friction force between said rotatable friction disks and said friction surfaces being determined so as to permit said rotatable friction disks to be rotated to rotate said take-up spool shaft when a rotational load applied to said take-up spool shaft is smaller than predetermined amount corresponding to a suitable tension of said print ribbon, but to cause a slip between said rotatable friction disks and said stationary member when said rotational load exceeds said predetermined amount.

9. A thermal printer according to claim 8, wherein said pair of friction disks have a pair of felt sheets secured to mutually facing surfaces thereof, said felt sheets being engageable with said respective opposite friction surfaces of said stationary member.

10. A thermal printer according to claim 9, further comprising an actuator supported on said carriage, movably between an operative position thereof in which said actuator is inserted between said pair of friction disks and moves the disk away from each other to thereby disengage said disks from said stationary member, and an inoperative position thereof in which said actuator is located away from said pair of friction disks.

11. A thermal printer according to claim 10, further comprising a support arm pivotally supported on said carriage and having said thermal print head fixed at a free end thereof, and a driving mechanism for operating said support arm, so as to move said print head between a printing position thereof in which the print head is held in pressed contact with said recording medium through said print ribbon, and a non-printing position thereof in which the print head is spaced away from said recording medium, said actuator being attached to said support arm so that said actuator is moved to said operative position when said thermal print head is moved to said non-printing position.

* * * * *